United States Patent [19]

Sharples

[11] 3,937,602

[45] Feb. 10, 1976

[54] ENGINE HOUSINGS

[75] Inventor: John Sharples, Sandbach, England

[73] Assignee: Rolls-Royce Motors Limited, Crewe, England

[22] Filed: Sept. 4, 1974

[21] Appl. No.: 503,083

[30] Foreign Application Priority Data

Sept. 15, 1973 United Kingdom ..... 43413/73

[52] U.S. Cl. ..... 418/83

[51] Int. Cl.[2] ..... F01C 21/06

[58] Field of Search ..... 418/60, 61 A, 83, 88; 123/8.01, 41.17, 41.79

[56] References Cited

UNITED STATES PATENTS

| | | | |
|---|---|---|---|
| 3,250,260 | 5/1966 | Heydrich | 418/101 X |
| 3,575,538 | 4/1971 | Berkowitz et al. | 418/149 X |
| 3,588,296 | 6/1971 | Toyama et al. | 418/83 |
| 3,644,070 | 2/1972 | Lermusiaux | 418/83 X |

*Primary Examiner*—C. J. Husar
*Assistant Examiner*—Leonard Smith
*Attorney, Agent, or Firm*—Cushman, Darby & Cushman

[57] ABSTRACT

The rotor housing of a rotary piston internal combustion engine comprises inner and outer walls between which coolant channels are defined. The channels are separated by webs and at least some of these webs, normally in the combustion areas, extend at an angle of 28½° to the radial direction to achieve a stress distribution which minimizes the risk of web root failure.

6 Claims, 6 Drawing Figures

Fig. 3.
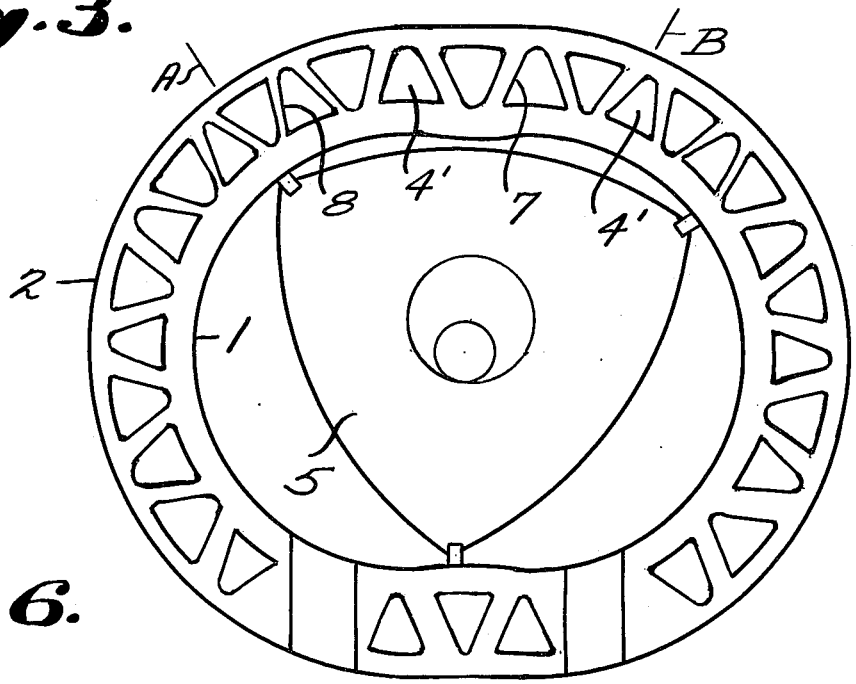
Fig. 6.
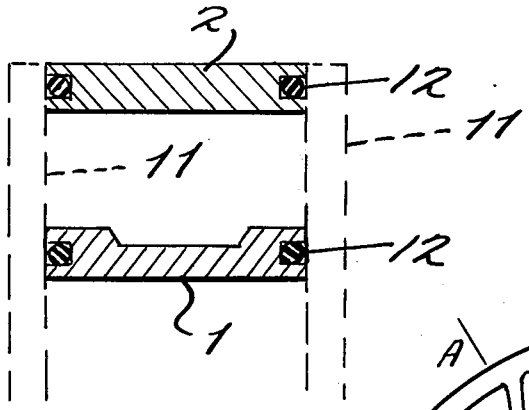
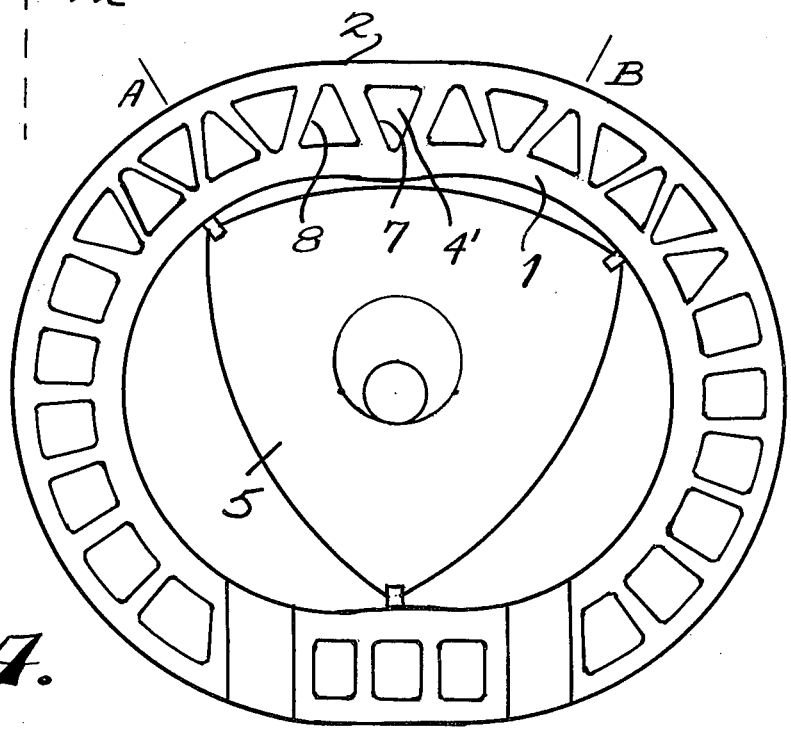
Fig. 4.

ENGINE HOUSINGS

The present invention relates to an engine housing and particularly, but not exclusively, to the housing of rotary piston internal combustion engines.

The housing itself for this type of engine generally comprises an inner peripheral wall which has an epitrochoidal internal surface, joined to an outer peripheral wall by a series of radially extending webs between which is defined a plurality of coolant channels extending parallel to the longitudinal axis of the housing.

In operation of this type of engine, the inner wall is heated to extremely high temperatures in the area where the combustion phase of the cycle occurs, and it has been found that the resulting thermal stresses can cause failure of the radial webs connecting the inner and outer peripheral walls.

According to the present invention, there is provided an engine housing defining a combustion chamber and having a curved internal wall surface, wherein the housing has inner and outer walls between which a plurality of coolant channels are disposed and adjacent channels are separated by webs which extend in a non-radial direction relative to the local curved internal wall surface.

In a preferred embodiment, the webs extend at an angle of 28½° to the radial direction.

Coolant channels may extend over the whole or a part of the periphery of the engine housing. Adjacent ones of all of these channels may be separated by webs which extend in a non-radial direction as described above or alternatively, only some of these adjacent channels would be separated by non-radial webs the other being separated by radial webs. Normally, the non-radial webs would be disposed adjacent those parts of the engine housing at which combustion occurs.

Figure 1:
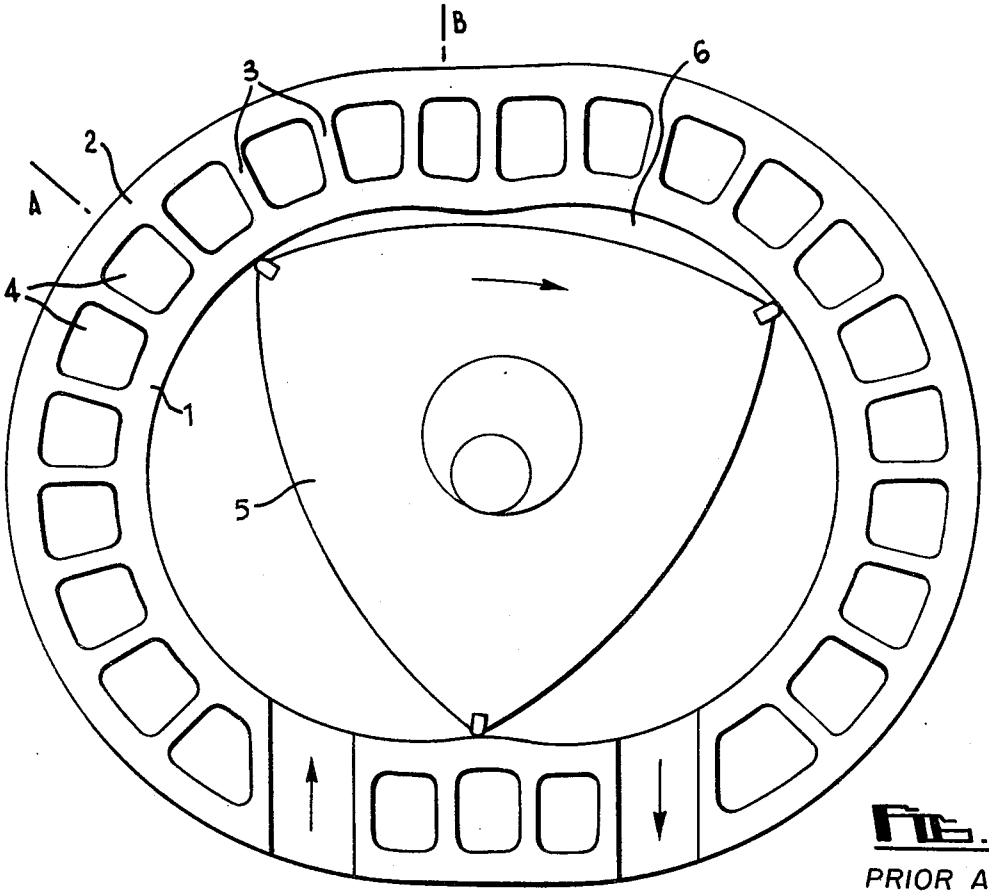
FIG. 1 PRIOR ART
Figure 2:
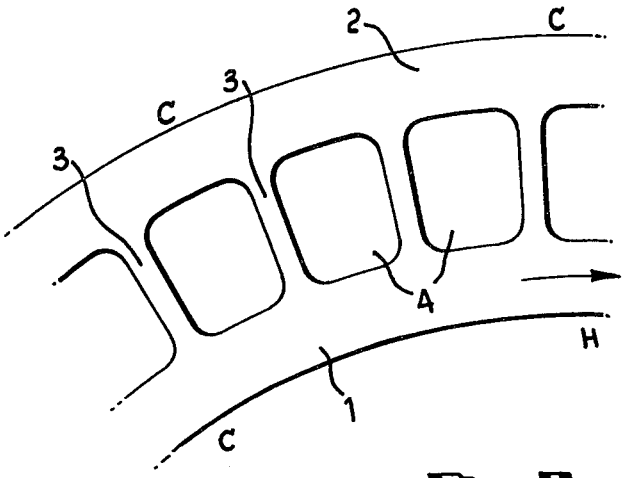
FIG. 2 PRIOR ART
Figure 5:
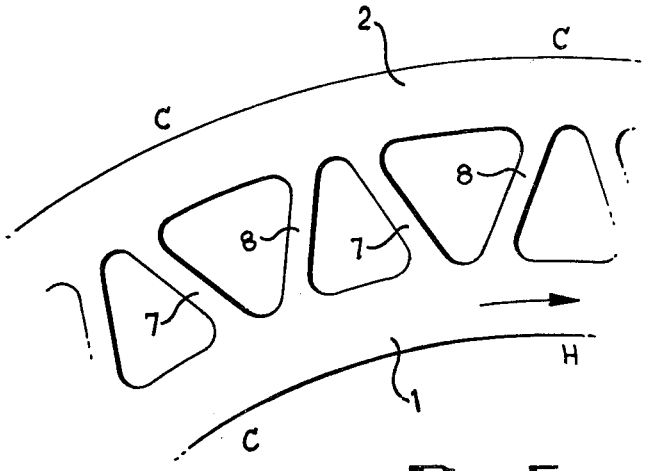

In order that the invention is more full understood, one embodiment thereof will now be described, by way of example, with reference to the accompanying drawings, in which:

FIG. 1 shows a cross section through a known housing for a rotary piston internal combustion engine, FIG. 2 shows a cross section through a part of a known housing, in the area between the lines A and B in FIG. 1, FIG. 3 shows a cross section through the housing of the present invention for a rotary piston internal combustion engine, FIG. 4 is a view similar to FIG. 3 but showing a modified housing of the present invention where the webs are inclined to the radial in the region where combustion takes place, FIG. 5 shows a cross section of a part of the housing of either FIG. 3 or FIG. 4 in the region A–B where combustion takes place, and FIG. 6 shows an axial cross section of a modification of the embodiments of FIG. 3 or FIG. 4.

Referring to FIG. 1, the known housing which may, for example, be of cast iron or aluminium comprises an inner wall 1 having an epitrochoidal internal surface, and an outer wall 2, joined together by radially extending webs 3 which define coolant channels 4 extending axially of the housing. The piston 5 is shown in the position in which combustion is about to begin in the working chamber 6. In the region where the combustion phase of the cycle occurs, the internal wall of the housing is heated to a very high degree, while over the remainder of the housing this wall stays relatively cool.

The section of the housing shown in FIG. 2 is in an area at one end of this hot region, between the lines A and B in FIG. 1, where the part of the inner wall marked C is considered to be relatively cool and the part marked H is very hot. The outer wall remains cool, being in contact with the coolant and the surrounding atmosphere. The part of the inner wall marked H therefore tends to expand in the direction of the arrow, and this transverse movement relative to the stationary outer wall imposes a shear load on the radial webs, causing tearing at the roots.

FIG. 3 shows a housing according to the invention, in which the inner and outer walls 1 and 2 are enclosed at opposite axial ends by rotor housing end plates 11 (FIG. 6). Also it will be noted that seals 12 (FIG. 3) are disposed in the axial ends of the walls 1 and 2 of the housing. Walls 1 and 2 are joined by webs 7 and 8, extending at an angle to the radial, to define coolant channels 4′ of substantially triangular cross section. In this arrangement, the transverse forces on the webs due to the expansion of the hot section of the inner wall are partly resolved into tensile and compressive components along the inclined webs, (tensile in webs 7 and compressive in webs 8), since any expansion of the inner wall in the direction of the arrow tends to increase the length of webs 7 and shorten webs 8. Thus the compressive restraint of the webs 8 reduces the relative movement between the inner and outer wall and consequently reduces the tensile and shear stresses at the roots of the webs. In addition to the thermal loads referred to above, the housing is also subjected to mechanical forces due to the expanding combustion gases. The existence of these mechanical forces determines the maximum allowable unsupported/length of inner housing wall and therefore the maximum distance apart of adjacent web roots. These mechanical forces act generally radially and tend to increase the forces in the webs 8 under compression and reduces them in the webs 7 under tension. Cast iron is a common housing material and as cast iron has great strength in compression, better use is made of the material. The stress distribution in the webs will of course vary depending upon the angle of the webs to the radial direction and it has been found that an angle of 28½° gives the best stress distribution.

This type of construction may be employed for the complete peripheral housing as shown in FIG. 3, or alternatively, the webs could be inclined to the radial only in the region where the combustion phase takes place as shown in FIG. 4, which is where the pressure and temperature are highest and thus where failure is most likely to occur.

It will be appreciated that the above embodiments have been described by way of example only and that many variations thereof are possible without departing from the scope of the invention. For example, as shown in FIG. 6, the thickness of the wall 1 could be reduced from a maximum at the axial ends to a minimum at the centre.

What is claimed is:

1. In an engine housing defining a combustion chamber having a curved internal wall surface, inner and outer walls with a plurality of cooling channels therebetween and webs separating adjacent channels, at least some of said webs extending at an angle in the region of 28½° to the radial direction relative to the local curved internal wall surface.

2. In an engine housing defining a combustion chamber and having a curved internal wall surface, inner and outer walls with a plurality of coolant channels therebetween and webs separating adjacent channels, at least some of said webs extending in a non-radial direction relative to the local curved internal wall surface such that the coolant channels bounded by those webs are of a triangular section and transverse forces on the said some of said webs extending in a non-radial direction due to expansion of the inner wall are at least partly resolved in to tensile or compression components in the said some of said webs.

3. An engine housing as claimed in claim 2, in which coolant channels extend over the whole of the periphery of the engine housing.

4. An engine housing as claimed in claim 2, in which the coolant channels extend over only a part of the periphery of the engine housing.

5. An engine as claimed in claim 2 in which rotor housing end plates are disposed at opposite ends respectively of the rotor housing and seals are disposed in the axial ends of the rotor housing.

6. An engine as claimed in claim 2, in which the thickness of at least one of the rotor housing walls varies from a maximum at its axial ends to a minimum at its centre.

* * * * *